US008636530B2

(12) United States Patent
Schoenfeld et al.

(10) Patent No.: US 8,636,530 B2
(45) Date of Patent: Jan. 28, 2014

(54) CONTACTING PLUG AS WELL AS CONTACTING CONNECTION

(75) Inventors: Michael Schoenfeld, Leinfelden-Echterdingen (DE); Wolfgang Pade, Illingen (DE); Hartmut Buschle, Fellbach (DE); Michael Fleig, Ra Tilburg (NL); Achim Puettner, Aalen (DE)

(73) Assignee: Robert Bosch GmbH, Stuttgart (DE)

( * ) Notice: Subject to any disclaimer, the term of this patent is extended or adjusted under 35 U.S.C. 154(b) by 112 days.

(21) Appl. No.: 13/140,707

(22) PCT Filed: Nov. 30, 2009

(86) PCT No.: PCT/EP2009/066036

§ 371 (c)(1),
(2), (4) Date: Aug. 30, 2011

(87) PCT Pub. No.: WO2010/069741

PCT Pub. Date: Jun. 24, 2010

(65) Prior Publication Data

US 2012/0015529 A1 Jan. 19, 2012

(30) Foreign Application Priority Data

Dec. 19, 2008 (DE) ..... 10 2008 054 944
Nov. 27, 2009 (DE) ..... 10 2009 047 221

(51) Int. Cl.
*H01R 12/00* (2006.01)

(52) U.S. Cl.
USPC ..... 439/260

(58) Field of Classification Search
USPC ..... 439/267, 269, 373, 325, 59, 260
See application file for complete search history.

(56) References Cited

U.S. PATENT DOCUMENTS

| | | | | |
|---|---|---|---|---|
| 3,130,351 | A * | 4/1964 | Giel | 361/759 |
| 3,594,649 | A | 7/1971 | Jayne et al. | |
| 4,077,688 | A * | 3/1978 | Cobaugh et al. | 439/267 |
| 4,533,189 | A * | 8/1985 | Scoccia et al. | 439/64 |
| 6,238,226 | B1 * | 5/2001 | Schempp et al. | 439/260 |
| 2008/0188130 | A1 | 8/2008 | Buschle et al. | |

FOREIGN PATENT DOCUMENTS

| | | |
|---|---|---|
| DE | 10 2005063239 | 6/2007 |
| EP | 0083862 | 7/1983 |
| EP | 0802584 | 10/1997 |
| EP | 1009068 | 6/2000 |

OTHER PUBLICATIONS

International Search Report, PCT International Patent Application No. PCT/EP 2009/066036, dated Mar. 17, 2010.

* cited by examiner

*Primary Examiner* — Neil Abrams
*Assistant Examiner* — Phuongchi T Nguyen
(74) *Attorney, Agent, or Firm* — Kenyon & Kenyon LLP

(57) ABSTRACT

A contacting plug for contacting a contact carrier, in particular a circuit board, having two clamping claws able to be pivoted relative to each other, transversely to a plug-in direction, at least one of which is implemented as contact holder carrying at least one flexible contact element, which contact holder is implemented with a contact force for resting on the contact carrier, and a spring arrangement for generating a clamping force that is independent of the contact force. According to the invention, the spring arrangement is designed for bracing exclusively on the contacting plug for generating the clamping force.

26 Claims, 10 Drawing Sheets

CONTACTING PLUG AS WELL AS CONTACTING CONNECTION

FIELD OF THE INVENTION

The present invention relates to a contacting plug for contacting a contact carrier, especially a circuit board, and to a contacting connection.

BACKGROUND INFORMATION

One conventional contacting connection, which includes a contacting plug as well as a contacting plug receptacle, is described in German Patent Application No. DE 10 2005 063 239 A1. The conventional contacting connection is characterized by the fact that the contact forces applied on a circuit board by contact elements are independent of clamping forces by which the clamping claws which carry the contact elements and are developed as contact holders rest on the circuit board. The conventional contacting connection has shown to be reliable. However, there seems to be room for improvement insofar as the clamping force by which the contact holders, which are able to pivot relative to each other, are pressed against the circuit board is dependent on the quality and on the inherent stability of the contacting plug receptacle, on which v-shaped spring, elements are supported in order to generate the clamping force. Any type of change in the shape or relaxation of the contacting plug receptacle under the influence of force or temperature can reduce the required clamping force. Another disadvantage is that the clamping force generated by the spring arrangement, which have a V-shaped cross-section, does not lie in the same working plane with the contact points of the contact elements for contacting the circuit board lands.

SUMMARY

The present invention relates to further developing the conventional contacting plug to the effect that force- or temperature-related changes in form of the contacting plug receptacle have no effect on the clamping force by which the contacting plug is supported on the contact carrier, especially a circuit board. Furthermore, a contacting connection using a correspondingly optimized contacting plug is also provided.

The present invention encompasses all combinations of at least two of the features disclosed in the specification, and/or the figures.

In accordance with the present invention, the contacting plug is autonomous with respect of the magnitude of the clamping force at which the clamping claws, preferably implemented as contact holders, are resting on the contact carrier, especially a circuit board. Put another way, the clamping force of the contacting plug acting on the clamping claws is at least approximately, preferably completely, independent of a contacting plug receptacle. In an example contacting plug in accordance with the present invention, to generate the clamping force, the spring arrangement no longer supports itself on the contacting plug receptacle in the final installation state of a contacting connection provided with the contacting plug, i.e., a contacting plug accommodated in the contacting plug receptacle, as is the conventional case, but instead is supported on the contacting plug exclusively. The spring arrangement thus exclusively engages with the contacting plug, such that the clamping claws, of which at least one is developed as contact holder supporting at least one flexible contact element, have a tendency to move towards each other. In still other words, the spring arrangement, which is supported solely on the contacting plug, preferably solely on the clamping claws in order to generate the clamping force, counteract an opening movement of the clamping claws forced during a plug-in process. Since the clamping force in the example contacting plug according to the present invention is no longer dependent on a form change or relaxation of the contacting plug receptacle, a drop below a minimally required clamping force is advantageously avoided. Furthermore, the structure of a contacting plug according to the present invention is able to be simplified considerably as a result of the special design and placement of the spring. Another advantage is that the clamping force is able to be generated even without providing a contacting plug receptacle, so that the provision of such a receptacle may be dispensed with from case to case. In general, it should be noted that the contacting plug suggested here may be developed as described in German Patent Application No. DE 10 2005 063 239 A1, except for the difference that the spring arrangement for generating the clamping force is not braced at the contacting plug receptacle but solely on the contacting plug.

In a further development of the present invention, the spring arrangement is advantageously developed and placed in such a way that the clamping force generated by the spring arrangement and the contact force generated by the at least one elastic contact element lie in one working plane. In other words, the force arrows of the previously mentioned forces lie in one plane in a force arrow model. For example, this may be achieved by placing the spring means directly outside the contact points at which the contact elements rest on the contact carrier, especially on lands or circuit traces of a circuit board.

Especially preferred is a specific embodiment of the contacting plug in which the contact holder has at least one contact surface defining the position of the contact element with respect to the contact carrier. In other words, the clamping claws are preferably provided with one contact surface in each case, which ensures a defined relative position of the contact elements relative to the circuit board, or a defined relative position of the receiving trenches for the contact elements relative to the circuit board when the clamping claws sit on the contact carrier in the final installation position, and thus cause defined prestressing of the metallic, elastic contact elements, such as of the type illustrated and described in German Patent Application No. DE 10 2005 063 239 A1.

In a further development of the present invention, it is advantageously provided that the contacting plug is designed to interact with at least one mating plug-in element that stresses the spring means when the contacting plug is plugged in. The mating plug-in element is preferably part of a contacting plug receptacle mentioned in the introduction, and is slipped into a corresponding receptacle (receiving channel) of the same when the contacting plug is plugged in, and causes the clamping claws to widen during the insertion process, i.e., relative pivoting of the same relative to each other, which in turn results in stressing of the spring arrangement.

In a further development of the present invention, the spring arrangement is of a peripherally closed configuration, i.e., it form a ring, which has a rectangular contour, in particular, which surrounds the clamping claws, preferably in transverse directions to their longitudinal extension. In other words, the spring arrangement encloses the clamping claws along the entire circumference and apply a spring force to them in a direction toward each another.

There are different possibilities with regard to the concrete form of the spring arrangement. Especially preferred is a development in which the spring arrangement is made up of at least two, preferably only two, especially preferred, identical spring elements, which are operatively connected to each other. For the operative connection of the spring elements, it is advantageous to connect the spring elements to each other in form-locking manner. Alternative developments are realizable as well, in which the springs are connected to each other with the aid of mechanical affixation elements, in particular, or a continuous material connection such as by welding. In addition, it is possible that the spring arrangement is made up of only a single spring element, which is fixed in place via its free ends and thus forms a ring.

Especially preferred is a specific development of the contacting plug, in which the at least one spring element, preferably the at least two spring elements, in particular the only two spring elements, are implemented as wire spring elements. It is especially preferred if the wire spring elements are connected to each other in form-locking manner, a connection by force-locking or a continuous-material connection, e.g., by soldering, welding or bonding, being realizable as well.

It is especially useful if the spring arrangement, which preferably includes a wire spring element, is guided inside a groove, preferably implemented as circular groove, on at least one of the clamping claws, preferably on both clamping claws. In this context it is especially preferred if the groove is disposed in a plane accommodating the contact points via which the contact elements are resting on the contact carrier.

According to an alternative specific development, it is also possible that the spring includes a ring made from an elastic material, e.g., a sealing material, which ring is implemented in the form of an O-ring, for example, surrounding the clamping claws in annular form in an especially preferred manner.

In addition or preferably as an alternative to a circumferential development of the spring, a specific development is realizable in which the spring includes at least one spring which subjects the clamping claw to a tensile load, which spring preferably engages on the sides of the clamping claws facing each other. This is preferably a helical spring or a spiral spring. In order to enable a symmetrical application of force on the clamping claw, a specific development is preferred in which two springs are provided, which are situated on different sides of the clamping claws and subject the clamping claw to tensile loading, preferably helical springs.

In order to realize an especially compact contacting plug, in a further preferred specific embodiment of the present invention the spring is developed as a spring having a first section aligned in the direction of tension, and a second section which adjoins the first section and is developed in the form of a hook; on the side facing away from the first section, the second section has a terminal region in each case, which is disposed at an angle to the direction of tension, the second sections at least generally being situated in a shared plane, and the second sections being brought into point-shaped contact when the spring elements are tensioned, the springs elastically deforming transversely to the direction of tension up to and beyond the terminal region and then snapping into place with form-locking. In other words, this means that the hook sections interacting with each other with form-locking give way laterally in a move toward each other, without this requiring space for the springs perpendicular to the joining direction.

In this context it is especially preferred if the angle amounts to between 30° and 60°, in particular 45°. At the indicated angular range, the installation forces that arise when the hook regions are pressed against each other are restricted to a useful measure, and simple, lateral giving way of the hooks is ensured at the same time.

In order to form a contacting plug having an especially compact design, in one alternative specific embodiment the spring arrangement is developed as a spring featuring two hook regions which interact with each other; the plane of the two hook regions is disposed at an angle relative to a joining plane running parallel to the joining direction, the angle preferably amounting to less than 45 degrees. Given opening regions of the hooks that are of the identical size, such a geometric placement of the hook regions requires less space than a placement at a right angle to the joining plane.

In one alternative specific embodiment, in order to achieve a compact spring or, alternatively, to reduce the required tensile forces of the springs during installation, the spring arrangement includes at least one spring and the at least one spring has at least one partially plasticized region.

The partial plastification is preferably obtained in that, prior to its installation, the spring is mechanically prestressed beyond the deformation path actually required during the installation.

In one alternative development, it is also possible to perform a heat treatment instead of a partial plastification.

The present invention also leads to a contacting connection including at least one previously described contacting plug, to which a contacting plug receptacle is assigned, preferably one that is able to be fixed in place on a contact carrier. In the contacting connection developed according to the concept of the present invention, the contacting plug receptacle basically assumes the sole task of protecting the contacting plug and of preventing unintentional unplugging counter to the plug-in direction. Due to the autonomous development of the contacting plug, the contacting plug receptacle is not involved in generating the clamping forces acting on the clamping claws. The contacting connection preferably is an electrical direct plug-in connection for contacting circuit boards of control devices and/or components, especially for door control devices and/or engine control devices in motor vehicles.

Additional advantages, features and details of the present invention derive from the description of preferred exemplary embodiments below as well as from the figures.

DETAILED DESCRIPTION OF EXAMPLE EMBODIMENTS

Figure 1:
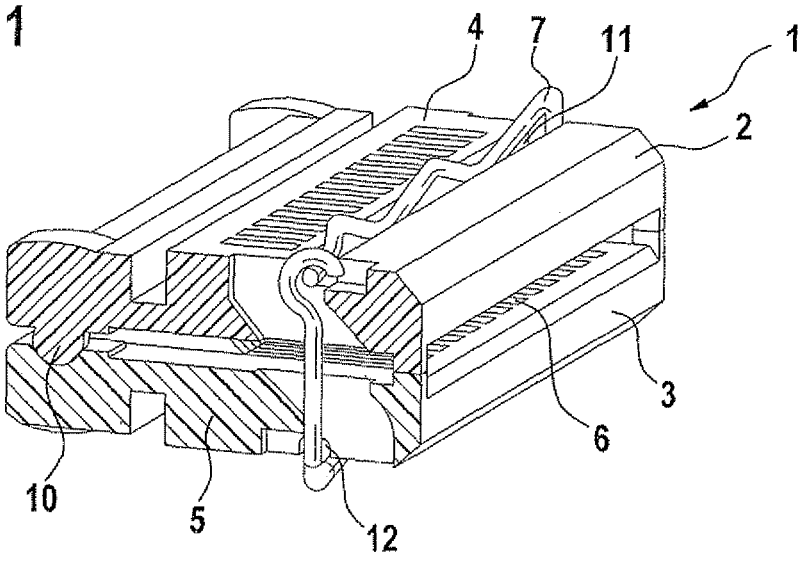
FIG. 1 shows a perspective view of one possible specific development of a contacting plug.

Identical elements and elements that have the same function have been provided with matching reference numerals in the figures.

Figure 2:
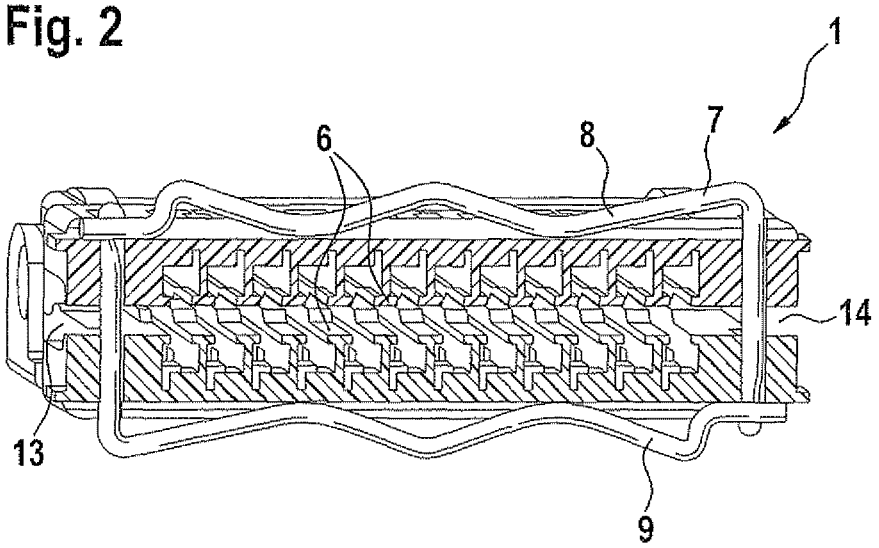
FIG. 2 shows a sectional view of the contacting plug according to FIG. 1.

FIGS. 1 and 2 show incomplete illustrations of one possible exemplary embodiment of a contacting plug 1 for the electrical contacting of a contact carrier (not shown), preferably implemented as circuit board, especially of lands or circuit tracks of the circuit board. With the aid of contacting plug 1, an electrically conductive connection is able to be established between a cable harness (not shown here) and the contact carrier. Contacting plug 1 includes two identically formed clamping claws 2, 3 disposed in mirror symmetry, which are implemented as contact holder 4, 5 in each case; in the exemplary embodiment shown, each contact holder 4, 5 has a multitude of adjacently disposed contact elements 6, which are used for the direct contacting of a contact carrier, more precisely, a circuit track or a land of a contact carrier. Male multipoint connectors are intentionally dispensed with in this case. Contact elements 6 are developed as metallic spring elements, which rest against the contact carrier with a contact force that is essentially oriented perpendicular to the surface extension of the contact carrier. The contact force at which contact elements 6 rest against the contact carrier is independent of a clamping force by which clamping claws 2, 3 brace themselves on the contact carrier generally in the normal direction.

Spring arrangement 7, which is made up of two spring elements 8, 9 implemented as wire spring elements, as can be gathered from FIG. 2, are provided to generate the clamping force. They are connected to each other in form-fitting manner and developed as identical parts in order to minimize production costs and to simplify the installation. As is obvious from FIG. 2, spring elements 8, 9 implemented as wire spring elements interlock with each other and thus form peripherally closed spring arrangement 7. In other words, spring elements 8, 9 form an annular spring element, which applies a spring force to clamping claws 2, 3 in a direction towards each other. Instead of producing a positive fit between spring elements 8, 9, they may additionally or alternatively also be fastened to each other by soldering, welding, bonding or by some other type of fastening means, in particular of a mechanical nature.

As can be gathered from FIG. 1, clamping claws 2, 3 are implemented as separate components, which are connected to each other via two pivot joints 10 (in this case, in the form of hinge joints) in a manner allowing pivoting; a development analogous to that described in German Patent Application No. DE 10 2005 063 239 A1 having clamping claws 2, 3 integrally formed with each other is realizable as well, which preferably are pivotable via a film hinge.

As can be gathered from an overall view of FIGS. 1 and 2, spring arrangement 7 is accommodated in grooves 11, 12 extending transversely to the longitudinal extension of contacting plug 1, the grooves guiding spring arrangement 7. Spring elements 8, 9 sectionally engage with these grooves 11, 12, which are disposed in such a way that they are located in one plane with the contact points (not shown) at which contact elements 6 are resting against the contact carrier (not shown) from both sides. The contact forces and also the clamping force acting on clamping claws 2, 3 thus lie in a shared working plane.

As can additionally be gathered from FIG. 2, spring elements 8, 9 have a rippled or serrated design on the upper side and on the lower side of contacting plug 1 and rest on clamping claws 2, 3 at defined points, which are set apart from each other transversely to the longitudinal extension of contacting plug 1, or transversely to plug-in direction E. In the illustrated exemplary embodiment, grooves 11, 12 have a generally cylindrical contour, but a rectangular, prismatic, trapezoidal or triangular cross-sectional contour of grooves 11, 12 is realizable as well.

Instead of the spring arrangement formed by wire spring elements, it is also possible to use a spring arrangement made of a preferably rubber-elastic elastomer material.

As can be gathered from FIG. 2, a receiving channel 13, 14 is provided on each longitudinal side of contacting plug 1, which channel is delimited by clamping claws 2, 3 and extends in plug-in direction E. Receiving channels 13, 14 accommodate a mating plug-in element, which preferably is located in the contacting-plug receptacle (not shown in FIGS. 1 and 2). The mating plug-in elements have corresponding leading slants and thus ensure that clamping claws 2, 3 are pivoted relative to each other about pivot joints 10 when inserted into the contact-plug receptacle; in the course of this pivoting process spring arrangement 7 is tensioned, and a spring force is applied to clamping claws 2, 3 in a direction toward each other.

Figure 3:
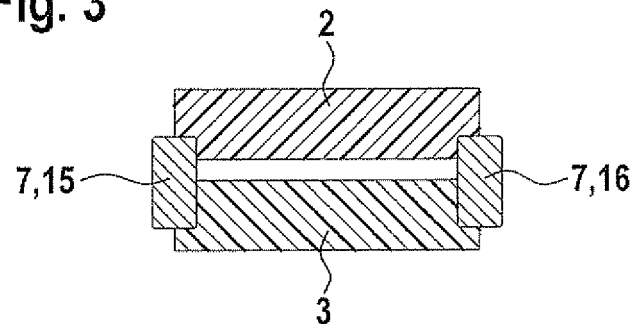
FIGS. 3 through 5 show different exemplary developments, shown in heavily schematized form, of a contacting plug having two spring elements developed as helical springs (tension springs) for generating a clamping force.
Figure 4:
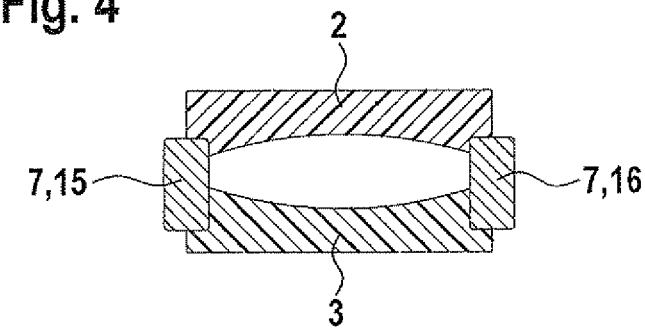
Figure 5:
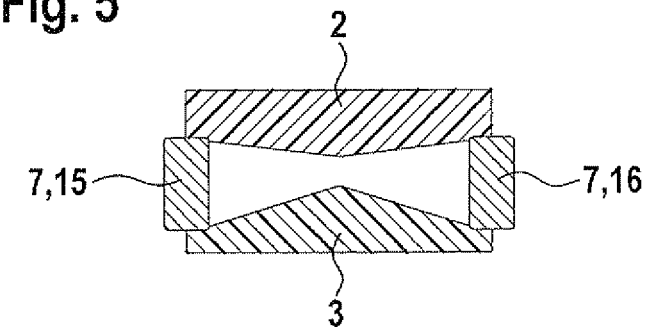

In highly schematic manner, FIG. 3 through 5 show different options for developing clamping claws 2, 3 having an associated spring arrangement 7. In the exemplary embodiment according to FIG. 3, spring arrangement 7 is made up of two helical springs 15, 16 disposed at a distance from each other and situated along the sides, which helical springs apply force to clamping claws 2, 3 with clearance from the pivoting joints (not shown).

In the exemplary embodiment according to FIG. 4, the sides of clamping claws 2, 3 facing each other have a concave shape transversely to their longitudinal extension, and a convex shape in the exemplary embodiment according to FIG. 5. Instead of helical springs 15, 16, it is also possible to use spiral springs or bar springs etc. Spring arrangement 7 should subject clamping claws 2, 3 to a spring force in a direction toward each other when clamping claws 2, 3 are pivoted relative to each other in the course of the plug-in operation.

Figure 6:
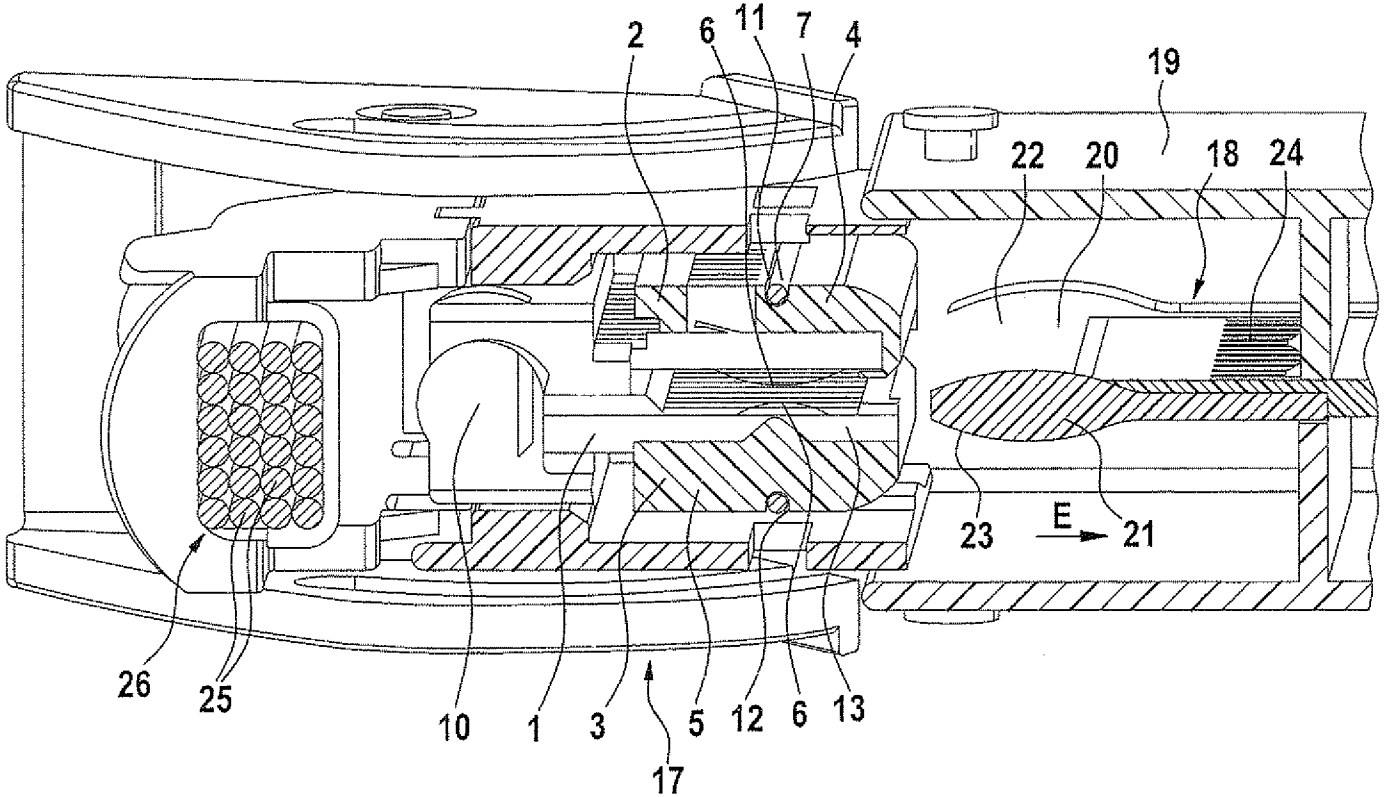
FIGS. 6 through 10 show different states during the contacting of a contact carrier formed as circuit board, having a contacting plug which is able to be accommodated in a contacting plug receptacle.

FIG. 6 shows a sectional view of a contacting connection 17 at the beginning of a plug-in operation. It includes a contacting plug 1, which essentially resembles the plug in FIGS. 1 and 2, and a contacting-plug receptacle 19, which is fixedly connected to a contact carrier 18 implemented as circuit board. Contacting-plug receptacle 19 includes two mating plug-in elements 20, 21, which are disposed at a distance from each other transversely to their longitudinal extension and developed and situated such that they are accommodated in receiving channels 13, 14 shown in FIG. 2. Only a front receiving channel 13 is shown in FIG. 6 through 10. It can be seen that mating plug-in elements 20, 21 have a leading slant 22, 23, which interacts with corresponding opposite surfaces of receiving channels 13, 14 when plugged in, such that clamping claws 2, 3 implemented as contact holders 4, 5 are pivoted relative to each other, about common pivot joints 10, in this case, away from each other.

It can be seen that contact carrier 18 is provided with a multitude of circuit tracks 24, contact holders 4, 5 carrying elastic contact elements 6 made of metal and assigned to circuit tracks 24, which contact elements are connected in electrically conductive manner to corresponding connection lines 25 of a cable harness 26.

FIG. 6 shows spring means 7, which are sectionally disposed in grooves 11, 12 on the rear sides of clamping claws 2, 3, and which apply a spring force directed toward each other to clamping claws 2, 3, in particular during the plug-in process in a plug-in direction E.

Figure 7:
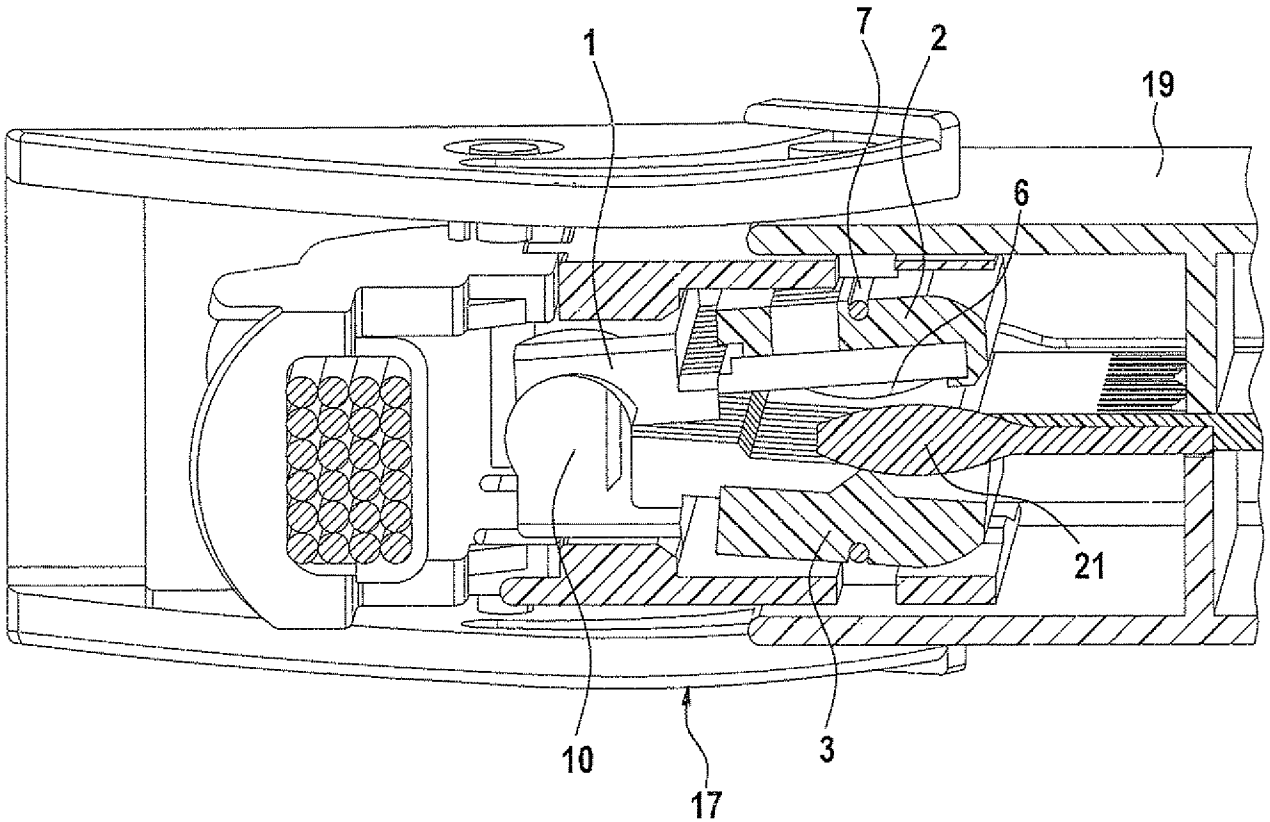

FIG. 7 shows a farther advanced inserted position of contacting plug 1 in contacting-plug receptacle 19. As can be seen, clamping claws 2, 3 were pivoted about pivot joints 10 in the manner of an opening clamping mouth, due to the expanding effect of mating plug-in elements 20, 21. This pivot movement is opposed by the clamping force generated by spring means 7. In the installed state, spring arrangement 7 is not braced on contacting plug receptacle 19 (housing of a control device).

Figure 8:
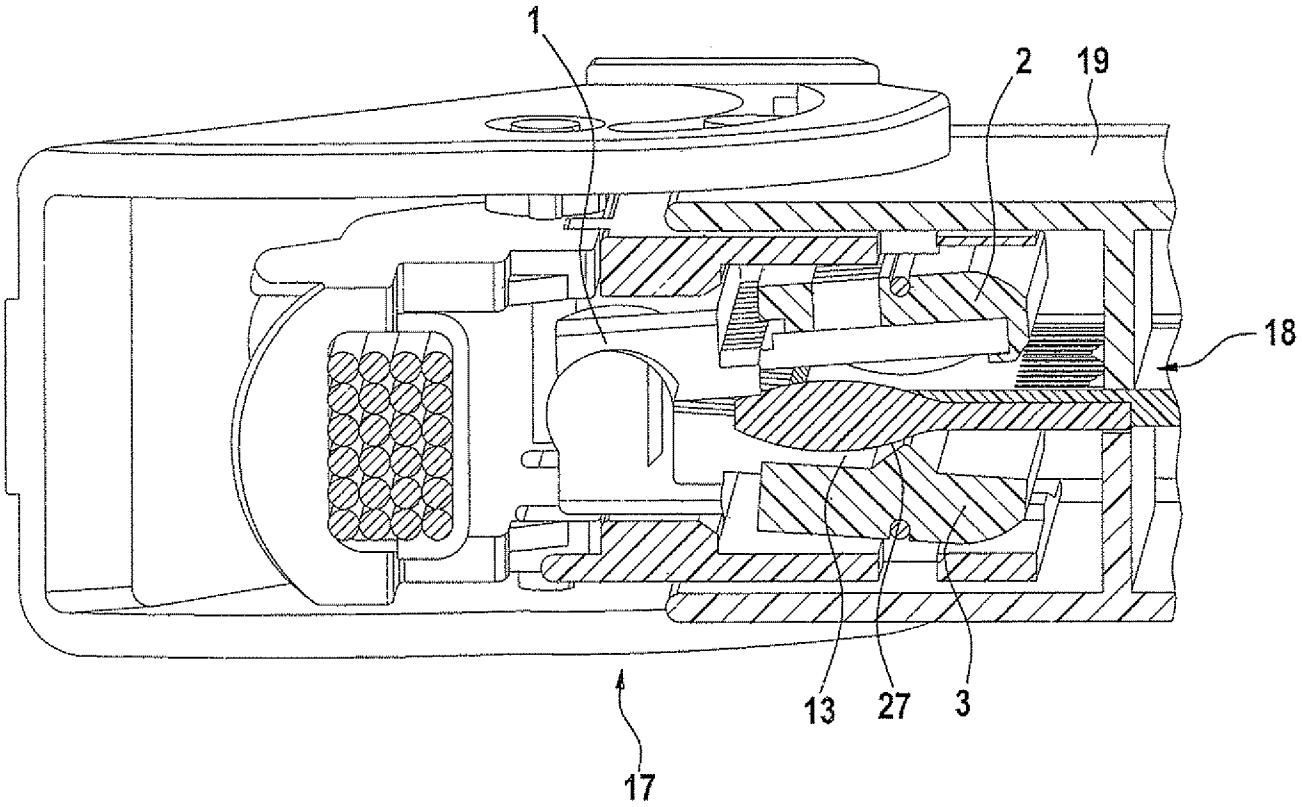

In the illustration according to FIG. 8, the plug-in process is even further advanced. It can be gathered that clamping claws 2, 3 are now moving toward each other again, which is due to the fact that corresponding gliding planes of receiving channels 13, 14 by now are traveling along leading slants 27 of mating plug-in elements 20, 21. In other words, a narrow passage formed by the sliding surfaces is just being overcome.

Figure 9:
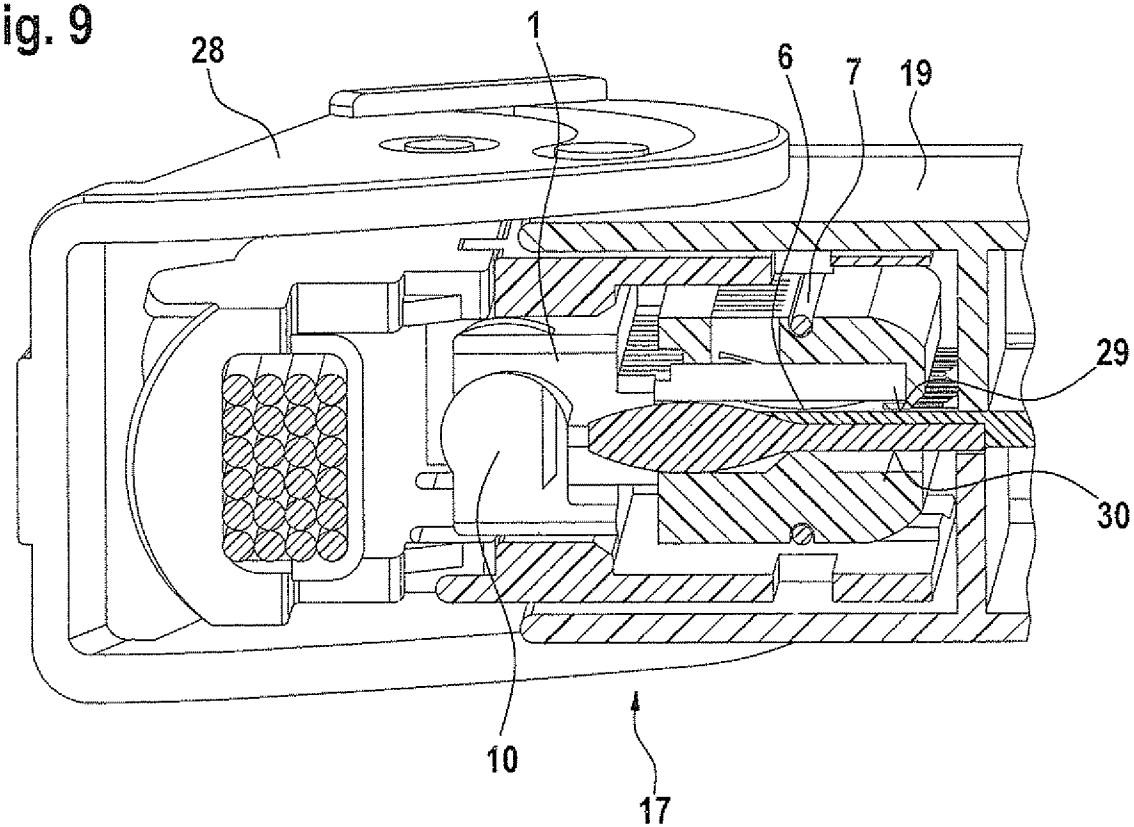

In the illustration according to FIG. 9, the final installation position of contacting plug 1 inside contacting-plug receptacle 19 generally has been achieved. Only a final lock 28, which will be explained further down, has not been closed yet. It can be gathered that clamping claws 2, 3 are braced via contact surfaces 29, 30, at the flat sides, that is to say, at both sides of contact carrier 18, contact surfaces 29, 30 guaranteeing a defined tension of contact elements 6, so that the clamping force generated by spring arrangement 7 does not affect the contact force at which contact elements 6 are resting on contact carrier 18.

Figure 10:
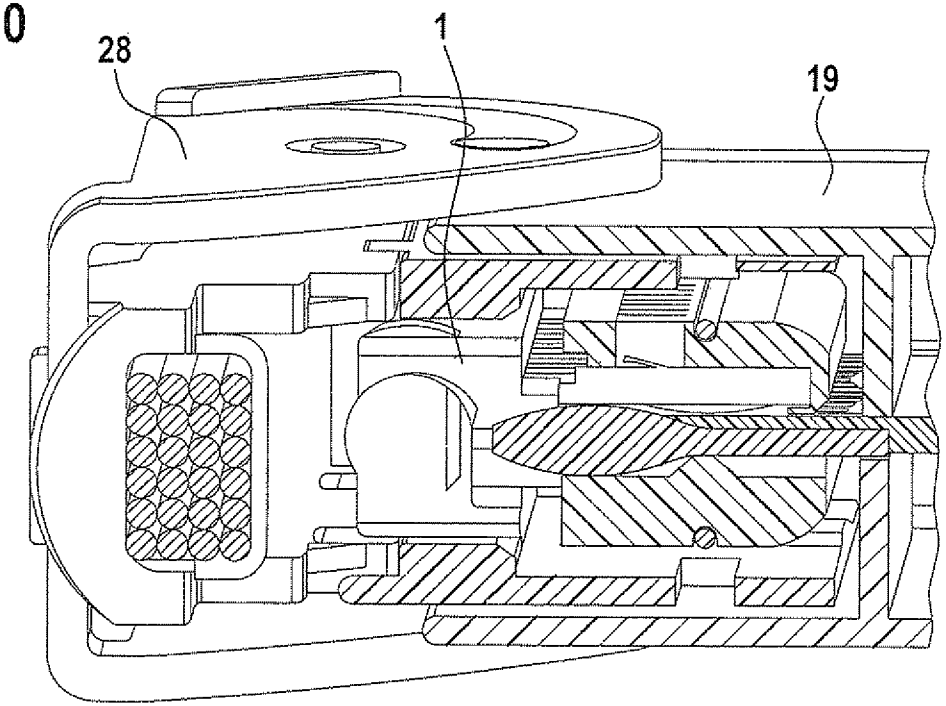

In the illustration according to FIG. 10, a previously mentioned final lock 28 was closed by pivoting. This secures contacting plug 1 on contacting-plug receptacle 19 against unintentionally being unplugged counter to plug-in direction E.

Figure 11:
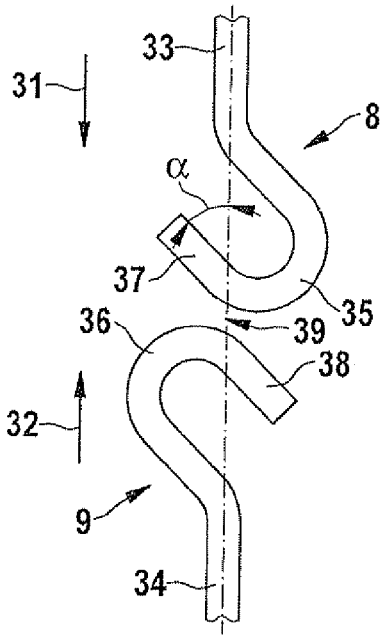
FIG. 11 through FIG. 13 show frontal views of a modified spring having an especially compact design, during the joining process.
Figure 12:
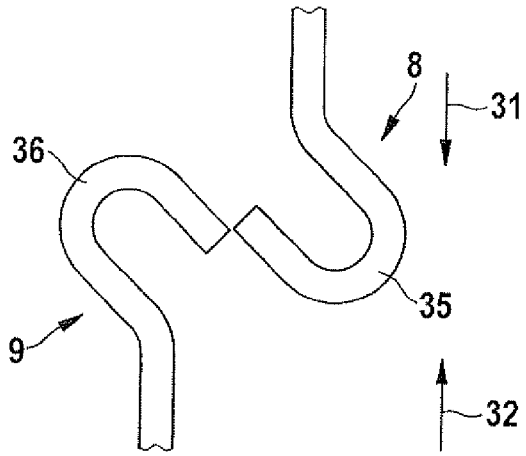
Figure 13:
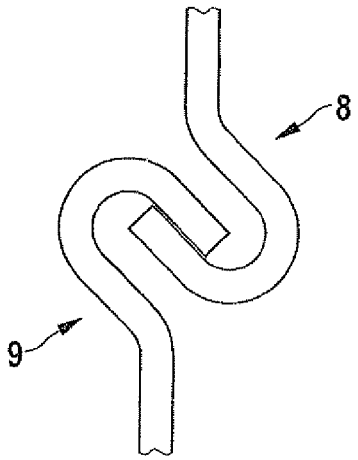

In FIG. 11 through 13, detail views of two interacting spring elements 8 and 9 are shown. Each spring element 8, 9 has a first section 33 and 34, which is disposed in the joining direction of arrows 31 and 32 and extends in a straight line, which is followed by a hook-type second section 35, 36. On the side facing away from first section 34 and 35, second sections 35 and 36 have a rectilinear end region 37, 38. End regions 37, 38 are disposed at an angle $\alpha$ relative to the joining direction according to arrows 31, 32, angle $\alpha$ being between 30° and 60°, in particular 45°.

First sections 33, 34 and second sections 35, 36 developed so far are generally disposed in a common plane which is disposed parallel to the drawing plane of FIG. 11 through 13. In a relative movement of spring elements 8 and 9 according to the direction of arrows 31 and 32, second sections 35 and 36 touch at a common contact point 39, in alignment with the extension of first sections 33 and 34; in a further movement of spring elements 8 and 9 toward each other, second sections 35 and 36 are then moved transversely away from each other, i.e., at right angles to arrows 31 and 32, this movement taking place within the elastic range of spring elements 8 and 9.

FIG. 12 shows the state in which second sections 35 and 36 have experienced their maximum transverse deflection and at the next instant lock into place with each other in form-fitting manner in a further movement in the direction of arrows 31 and 32, i.e., elastically spring back transversely into their original position as shown in FIG. 13.

Figure 14:
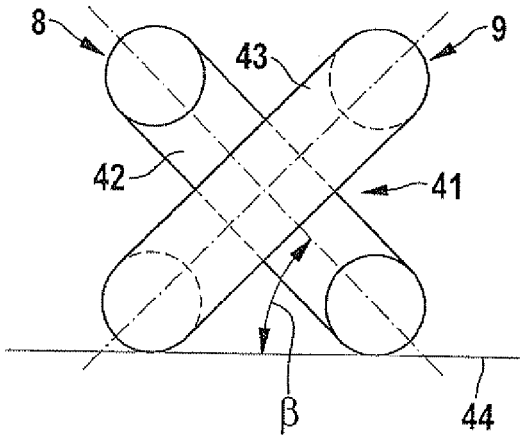
FIG. 14 shows a plan view of two interacting, hook-shaped regions of a spring likewise having an especially compact design.

FIG. 14 shows a plan view of a connection region 41 of two spring elements 8 and 9. Here, hook-shaped regions 42 and 43, which have a similar design as in FIG. 11 through 13, can be seen, which are disposed at a 90° offset from each other. It is essential to the present invention that tilting, e.g., of hook-shaped region 42, in the direction of a joining plane 44 enables a space-saving placement of hook-shaped regions 42 and 43. The space savings become greater as angle $\beta$ decreases. For example, angle $\beta$ according to the specific embodiment of FIGS. 11 through 13 amounts to zero degrees. In contrast, in the exemplary embodiment shown in FIG. 14, angle $\beta$ for regions 42 and 43 amounts to 45° in each case, angles $\beta$ of less than 45° preferably being selected.

Figure 15:
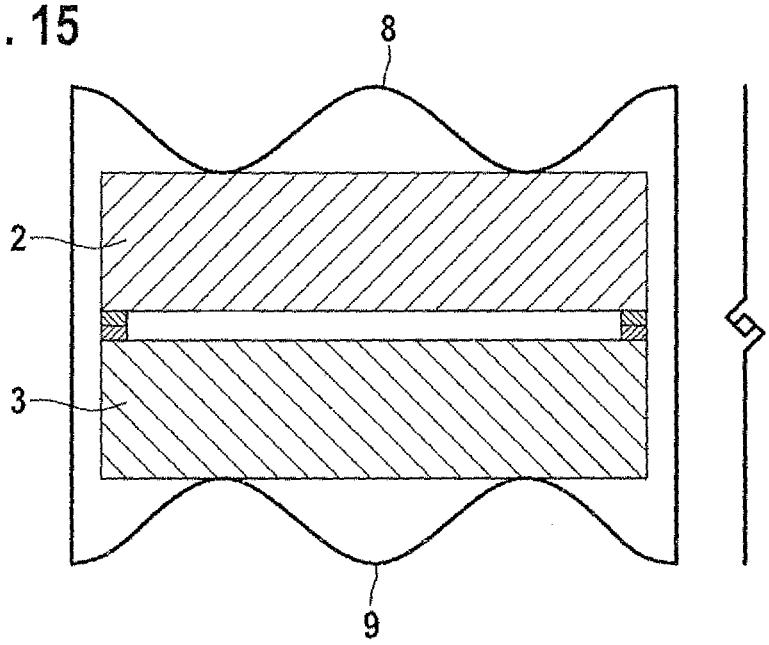
FIGS. 15 through 16 show a frontal view of a contacting plug having a spring enclosing the contacting plug, during the installation process.
Figure 16:
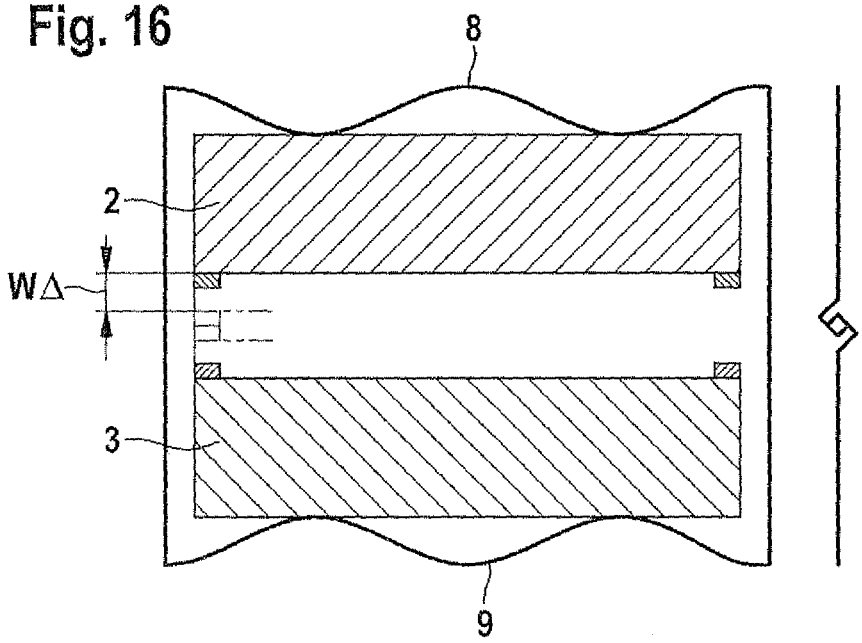
Figure 17:
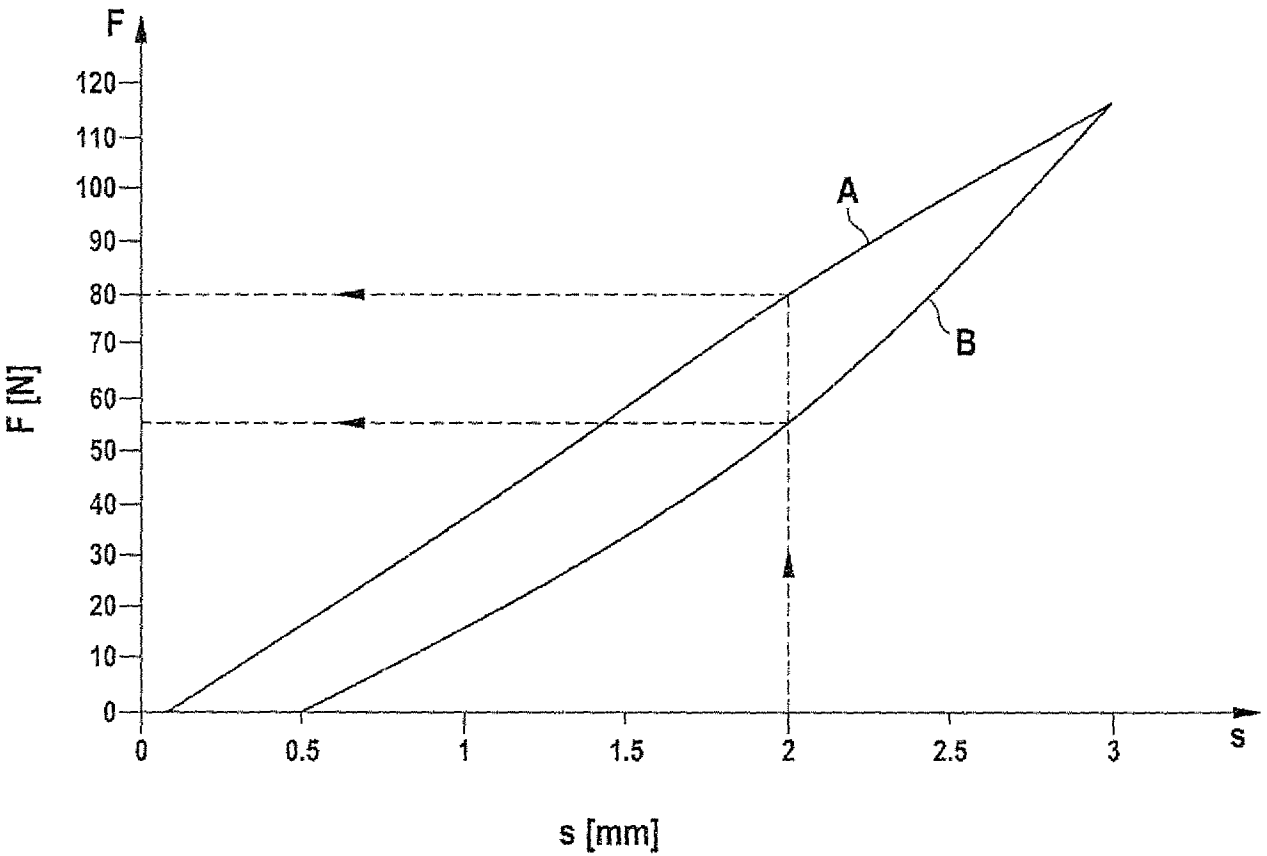
FIG. 17 shows a graphic representation to illustrate the effect of a partial plastification of a spring.

FIGS. 15 and 16 show the front view of two clamping claws 2 and 3, which are enclosed by two spring elements 8 and 9. Based on FIG. 15, which represents the state of clamping claws 2 and 3 in which they are not yet in contact with contact carrier 18, it can be seen that spring elements 8 and 9 are acted upon by a prestressing force that presses the two clamping claws 2 and 3 against each other. When passing leading slants 22 and 23, clamping claws 2 and 3 are moved away from each other according to FIG. 16, spring elements 8 and 9 becoming longer, i.e., deforming plastically. In order to realize especially compact spring elements 8 and 9, or alternatively, in order to reduce the required opening forces when clamping claws 2 and 3 are pressed apart, an example embodiment of the present invention provides for the plastification of spring elements 8 and 9, at least in subregions. Toward this end, reference is now made to FIG. 17, which represents a force-path diagram of a spring element 8 and 9. In this context it shall be assumed that leading slants 22 and 23 are deflected by a spring excursion s of 2 mm when being passed. If one views curve A of a completely elastic spring element 8 or 9, then it becomes clear that in order to achieve a spring excursion s of 2 mm simply by way of example in the exemplary embodiment, a force of close to 80 Newton, also by way of example, is required. According to the present invention, it is now provided that spring element 8 or 9 is deflected by a spring excursion s of 3 mm prior to its installation. This has the result that, starting from the end point of curve A, spring element 8 or 9 springs back according to curve B in a subsequent tension release. In this context, it does not spring back to its original length of 0 mm, but features a path s of 0.5 mm. In other words, spring element 8 or 9 has a subregion which has plastically deformed, from which residual spring excursion s of 0.5 mm results. If spring elements 8 or 9 are then newly deflected up to a spring excursion of 2 mm, this merely requires a force of approximately 55 Newton according to the present invention.

If the forces resulting from the plastified region are too low, a subsequent heat treatment in the form of "age-hardening" or "tempering" may partially cancel the introduced internal stresses. In the process, spring elements 8 and 9 are stored in an oven for a certain period of time and at a specific temperature. As an alternative, it is also possible not to prestress spring elements 8 or 9 mechanically or not to plasticize them, but to treat them by an age-hardening process at relatively low temperatures and for a relatively short external storage period. Depending on the level of the temperature and the duration of the heat treatment, the curve shape of curves A and B may be influenced in the process.

What is claimed is:

1. A contacting plug for contacting a contact carrier, comprising:

two clamping claws able to be pivoted relative to each other, transversely to a plug-in direction, at least one of which is implemented as contact holder carrying at least one flexible contact element, which contact holder is implemented with a contact force for resting on the contact carrier; and a spring arrangement to generate a clamping force that is independent of the contact force, wherein the spring arrangement braces against the contacting plug exclusively for the generation of the clamping force, wherein the spring arrangement is configured and placed such that the contact force and the clamping force lie in a common working plane running essentially perpendicular to the plug-in direction.

2. The contacting plug as recited in claim 1, wherein the contact carrier is a circuit board.

3. The contacting plug as recited in claim 1, wherein the contact holder has at least one contact surface defining a position of the contact element relative to the contact carrier.

4. The contacting plug as recited in claim 1, wherein the contacting plug is configured to interact with a mating plug-in element which tensions the spring arrangement when the contacting plug is plugged in.

5. The contacting plug as recited in claim 1, wherein the spring arrangement is of closed configuration around a periphery of the contacting plug.

6. The contacting plug as recited in claim 1, wherein the spring arrangement includes at least one wire spring element.

7. The contacting plug as recited in claim 1, wherein the spring arrangement is guided in a circumferential groove on the clamping claws.

8. The contacting plug as recited in claim 1, wherein the spring arrangement includes at least one of a helical spring, a spiral spring, an elastomer seal, and an elastomer-ring.

9. The contacting plug as recited in claim 1, wherein the spring arrangement includes at least one spring.

10. The contacting plug as recited in claim 9, wherein the spring arrangement includes at least one spring and the at least one spring has at least one partially plastified region.

11. The contacting plug as recited in claim 10, wherein the partial plastification takes place by mechanical prestressing via a deformation occurring during installation.

12. The contacting plug as recited in claim 9, wherein the spring arrangement includes at least one spring, the at least one spring having at least one region treated by a heat treatment.

13. The contacting plug as recited in claim 12, wherein the heat treatment includes an age-hardening process.

14. A contacting plug for contacting a contact carrier, comprising:

two clamping claws able to be pivoted relative to each other, transversely to a plug-in direction, at least one of which is implemented as contact holder carrying at least one flexible contact element, which contact holder is implemented with a contact force for resting on the contact carrier; and a spring arrangement to generate a clamping force that is independent of the contact force, wherein the spring arrangement braces against the contacting plug exclusively for the generation of the clamping force, wherein the spring arrangement includes at least two spring elements which are identical and connected to each other operatively.

15. The contacting plug as recited in claim 14, wherein the spring arrangement includes only two spring element.

16. The contacting plug as recited in claim 14, wherein the spring elements are connected to each other with form-locking.

17. A contacting plug for contacting a contact carrier, comprising:

two clamping claws able to be pivoted relative to each other, transversely to a plug-in direction, at least one of which is implemented as contact holder carrying at least one flexible contact element, which contact holder is implemented with a contact force for resting on the contact carrier; and a spring arrangement to generate a clamping force that is independent of the contact force, wherein the spring arrangement braces against the contacting plug exclusively for the generation of the clamping force, wherein the spring arrangement includes at least one spring, wherein the spring arrangement includes at least two spring elements, each having a first section aligned in a direction of tension, and a hook-shaped second section which adjoins the first section, the second section on a side facing away from the first section having an end region, which is disposed at an angle relative to the direction of tension, the second section being at least generally disposed in a shared plane, and the second sections coming into point-shaped contact when the spring elements are tensioned, and the spring elements elastically deform transversely to the direction of tension, up to and beyond the end region and latch with form-fitting.

18. The contacting plug as recited in claim 17, wherein the angle is between 30° and 60°.

19. The contacting plug as recited in claim 18, wherein the angle is 45°.

20. A contacting plug for contacting a contact carrier, comprising:

two clamping claws able to be pivoted relative to each other, transversely to a plug-in direction, at least one of which is implemented as contact holder carrying at least one flexible contact element, which contact holder is implemented with a contact force for resting on the contact carrier; and a spring arrangement to generate a clamping force that is independent of the contact force, wherein the spring arrangement braces against the contacting plug exclusively for the generation of the clamping force, wherein the spring arrangement includes at least one spring, wherein the spring arrangement includes at least two spring elements, each having a hook region which cooperate with each other, and a plane of the hook regions being disposed at an angle with respect to a joining plane extending parallel to a joining direction, the angle being less than 45 degrees.

21. A contacting connection comprising:

a circuit board; and a contacting plug able to be plugged in into a contacting plug receptacle of the circuit board, the contacting plug including two clamping claws able to be pivoted relative to each other, transversely to a plug-in direction, at least one of which is implemented as contact holder carrying at least one flexible contact element, which contact holder is implemented with a contact force for resting on the contact carrier; and a spring arrangement to generate a clamping force that is independent of the contact force, wherein the spring arrangement braces against the contacting plug exclusively for the generation of the clamping force, wherein the spring arrangement is configured and placed such that the contact force and the clamping force lie in a common working plane, which working plane extends substantially orthogonal with respect to the plug-in direction.

22. A contacting connection comprising:

a circuit board; and a contacting plug able to be plugged in into a contacting plug receptacle of the circuit board, the contacting plug including two clamping claws able to be pivoted relative to each other, transversely to a plug-in direction, at least one of which is implemented as contact holder carrying at least one flexible contact element, which contact holder is implemented with a contact force for resting on the contact carrier; and a spring arrangement to generate a clamping force that is independent of the contact force, wherein the spring arrangement braces against the contacting plug exclusively for the generation of the clamping force, wherein the spring arrangement is configured and placed such that the contact force and the clamping force lie in a common working plane, wherein the spring arrangement is of closed configuration around a periphery of the contacting plug.

23. A contacting plug for contacting a contact carrier, comprising:

two clamping claws able to be pivoted relative to each other, transversely to a plug-in direction, at least one of which is implemented as contact holder carrying at least one flexible contact element, which contact holder is implemented with a contact force for resting on the contact carrier; and a spring arrangement to generate a clamping force that is independent of the contact force, wherein the spring arrangement braces against the contacting plug exclusively for the generation of the clamping force, wherein the spring arrangement is configured and placed such that the contact force and the clamping force lie in a common working plane, wherein the spring arrangement is of closed configuration around a periphery of the contacting plug.

24. The contacting plug as recited in claim 23, wherein the spring arrangement forms a ring having a rectangular contour around the clamping claws.

25. The contacting plug as recited in claim 23, wherein the spring arrangement surrounds the clamping claws in a transverse direction to a longitudinal extension of the clamping claws.

26. The contacting plug as recited in claim 23, wherein the spring arrangement encloses the clamping claws along an entire periphery of the clamping claws.

* * * * *

UNITED STATES PATENT AND TRADEMARK OFFICE

CERTIFICATE OF CORRECTION

PATENT NO. : 8,636,530 B2
APPLICATION NO. : 13/140707
DATED : January 28, 2014
INVENTOR(S) : Schoenfeld et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 183 days.

Signed and Sealed this
Twenty-second Day of September, 2015

Michelle K. Lee

Michelle K. Lee
*Director of the United States Patent and Trademark Office*